US005713339A

United States Patent [19]

Kishida et al.

[11] Patent Number: 5,713,339

[45] Date of Patent: Feb. 3, 1998

[54] APPARATUS AND METHOD FOR IMPLEMENTING LEAN-BURN CONTROL OF INTERNAL COMBUSTION ENGINES

[75] Inventors: Hajime Kishida; Tatsuji Ooba, both of Iwata, Japan

[73] Assignee: Yamaha Hatsudoki Kabushiki Kaisha, Iwata, Japan

[21] Appl. No.: 650,689

[22] Filed: May 20, 1996

[30] Foreign Application Priority Data

May 22, 1995 [JP] Japan ..... 7-122443
May 19, 1995 [JP] Japan ..... 7-120991

[51] Int. Cl.[6] ..... F02D 41/00

[52] U.S. Cl. ..... 123/676

[58] Field of Search ..... 123/676, 686, 123/491, 571, 435; 60/285, 284, 274, 276; 205/784

[56] References Cited

U.S. PATENT DOCUMENTS 4,683,857 8/1987 Yasuoka ..... 123/676
4,971,010 11/1990 Iwata ..... 123/435
5,193,513 3/1993 Marko et al. ..... 123/571
5,216,881 6/1993 Anlauf et al. ..... 60/276
5,349,936 9/1994 Uchinami ..... 123/676

*Primary Examiner*—Raymond A. Nelli
*Attorney, Agent, or Firm*—Knobbe, Martens, Olson & Bear LLP

[57] ABSTRACT

An apparatus for lean-burn control of an internal combustion engine, comprising: an exhaust pressure-sensor for measuring the exhaust pressure in the exhaust system of the internal combustion engine at least when the internal combustion engine is subjected to lean combustion; a decision means for determining whether misfiring occurs in the internal combustion engine, based on the measured exhaust pressure; and a control unit for controlling the fuel/air ratio of intake mixed gas introduced into the internal combustion engine, based on the determination of the occurrence of misfiring, thereby accurately and quickly detecting and preventing the occurrence of misfiring and achieving super-lean burn control.

24 Claims, 8 Drawing Sheets

Concept of Engine Control

APPARATUS AND METHOD FOR IMPLEMENTING LEAN-BURN CONTROL OF INTERNAL COMBUSTION ENGINES

BACKGROUND OF THE INVENTION

1. Field of the Invention

The present invention relates to an apparatus and a method for lean-burn control of an internal combustion engine, and in particular, to such an apparatus and a method which allow for stable super-lean combustion by accurately and quickly detecting and preventing misfiring, thereby decreasing generation of $NO_x$ and improving fuel efficiency. Further, such an apparatus and a method allow for efficient cleansing of exhaust gas while implementing lean-burn control. The present invention also relates to an internal combustion engine, such as an engine used in an engine-driven heat-pump apparatus, comprising such an apparatus.

2. Background of the Art

The use of catalytic converters using oxidizing catalysts to remove CO and HC, and reducing catalysts to remove CO and $NO_x$, etc., or three element catalyst, is known to the art as method of cleansing exhaust gas emissions from internal combustion engines. These mainly used in automobile engines.

Further, it is also known that lean combustion is an effective method of cleansing exhaust gas emissions, especially in reducing $NO_x$ emissions. One approach to implementing this lean-burn method, disclosed in Japanese Patent Laid-open No. Hei6-288365, is to drive the gasoline engine using an fuel/air ratio at the extreme lean limit while monitoring the vibrational fluctuation rate from the engine acceleration data, thereby exercising control to maintain a permissible fluctuation level very close to the level at which unstable combustion would be caused. The control system described in the Japanese Patent Laid-open publication is operated by computing the vibration fluctuation rate from the output of a vibration sensor mounted on the gasoline engine, and then performing feedback control of a means to regulate the fuel flow so as to sustain the vibration fluctuation rate within predetermined limits.

In addition to automobile engines, engines used in heat pump apparatuses also involve exhaust gas and fuel issues. Engine-driven heat pump apparatuses are used as air-conditioning systems that employ a waste heat recovery heat-exchanger to effectively use waste heat from the gasoline engine. Such air conditioning devices have an important influence on exhaust gas and fuel issues in engines.

However, since the prior art technology described in the above Japanese Patent Laid-open publication performs lean burning by controlling the fuel supply to maintain the vibration fluctuation within permissible limits, based on the fluctuation rate computed from the output of a vibration sensor, when approaching the lean limits, the weight of the engine remarkably affects the vibration sensor's characteristics. Thus, even if misfiring is occurring, it cannot be detected unless the lean-burn limits are exceeded. Accordingly, the response to misfiring is poor in the lean limit area, and if misfiring continues while the engine is operating, it results in unburned gas flowing into the exhaust system and in poor fuel economy.

In the heat pump type of air conditioning apparatus employed in the prior art, no attempts were made to efficiently control engine performance and cleansing of exhaust gas in consideration of recovery of waste heat from the exhaust gases or lean-burn combustion. The only step to ease the exhaust-related problems was to simply place a catalytic converter in the exhaust passage.

SUMMARY OF THE INVENTION

The present invention has exploited lean-burn operation of an internal combustion engine with accurate and quick response to misfiring to stabilize super-lean combustion and with efficient cleansing of exhaust gas. An objective of the present invention is to solve the above-described drawbacks in the prior art by providing an apparatus and a method for lean-burn control of an internal combustion engine, performing accurate control of the fuel/air ratio in order to Operate super-lean combustion near the lean mixture limits, thereby reducing $NO_x$ emissions and preventing unburned fuel from flowing into the exhaust system, and further performing efficient cleansing of exhaust gas using a catalytic converter. By stable operation of lean-burning, it is possible to improve fuel economy and stabilize the recoverable energy from the exhaust gas.

Namely, one important aspect of the present invention is an apparatus for lean-burn control of an internal combustion engine, comprising: an exhaust pressure-sensing means for measuring the exhaust pressure at a detection point in an exhaust system of said internal combustion engine at least when said internal combustion engine is subjected to lean combustion; a decision means for determining whether misfiring occurs in said internal combustion engine, based on the measured exhaust pressure; and a control unit for controlling the fuel/air ratio of intake mixed gas introduced into said internal combustion engine, based on the occurrence of misfiring. When misfiring occurs, the pressure during the exhaust stroke remains low, as the gas is expelled from the combustion chamber into the exhaust system, and accordingly, the exhaust pressure drops immediately. By detecting misfiring on the basis of the exhaust pressure, it is possible to detect misfiring immediately after the occurrence of misfiring, thereby achieving highly responsive operation against the occurrence of misfiring. Thus, super-lean burn control becomes possible, and this greatly reduces $NO_x$ emissions and improves fuel economy.

In the above apparatus, the exhaust pressure detection point is preferably located in an exhaust passage connected to an exhaust port of said internal combustion engine. By detecting the exhaust pressure in the exhaust passage rather than in the combustion chamber, precise detection of misfiring is made possible with a small sensor having a simple structure.

When the apparatus further comprises a crank angle-sensing means for sensing the crank angle, wherein the exhaust pressure-sensing means is activated when the crank angle-sensing means senses a given crank angle, and when the decision means determines the occurrence of misfiring by comparing the sensed exhaust pressure with a given exhaust pressure at the given crank angle (e.g., the average exhaust pressure up to the time when the exhaust pressure is measured), a high degree of precision with respect to the absolute values is not required for the exhaust pressure-sensing means (i.e., accuracy with respect to relative values is sufficient), and accordingly, pressure fluctuation is reliably detected even if the standard of absolute values, zero drift, occurs.

In the aforesaid apparatus, typically, the control unit controls a fuel control valve provided in the internal combustion engine, based on the occurrence of misfiring.

When the exhaust pressure-sensing means is disposed inside an exhaust manifold when furnished in the internal combustion engine, it is possible to readily detect misfiring for all of the cylinders. On the other hand, when the exhaust pressure-sensing means is disposed in each exhaust passage when the internal combustion engine has multi cylinders, prevention of misfiring can be more certain.

Another important aspect of the present invention is an apparatus having the above features and further comprising a catalytic converter for cleansing exhaust gas downstream of the exhaust pressure detection point in an exhaust passage in the exhaust system. By locating the catalytic converter downstream of the exhaust pressure-sensing means, it is possible to eliminate effects from pressure changes, thereby preventing any decline in the accuracy of misfiring detection and enhancing the exhaust gas cleansing action.

When the above apparatus further comprises a heat recovery means (e.g., a heat-exchanger) for recovering heat from the exhaust gas in the exhaust passage, it is possible to use waste heat from the exhaust gas for compensating for insufficient endothermic heat in a heat pump apparatus, for example. When the heat recovery means is disposed downstream of the catalytic converter, the heat of oxidation of the unburned gases can be recovered. When the heat recovery means is disposed upstream of the catalytic converter, the overheating of the catalyst can be prevented.

The present invention is adapted to be embodied in both an apparatus for lean-burn control and a method therefor. Further, the present invention is adapted to be embodied in any type of internal combustion engines such as those used in engine-driven heat pump apparatuses for heating and cooling (including freezing).

Thus, still another important aspect of the present invention is a method for lean-burn control of an internal combustion engine, comprising the steps of: (a) measuring the exhaust pressure at a detection point in an exhaust system (preferably in an exhaust passage connected to an exhaust port) of said internal combustion engine at least when said internal combustion engine is subjected to lean combustion; (b) determining the occurrence of misfiring in said internal combustion engine, based on the measured exhaust pressure; and (c) controlling the fuel/air ratio of intake mixed gas introduced into said internal combustion engine, based on the determination of the occurrence of misfiring. As a preferable embodiment of the above method, in step (a), said internal combustion engine is subjected to lean combustion by decreasing, at a given rate, the fuel/air ratio of intake mixed gas introduced into said internal combustion engine in normal combustion, and, in step (c), the fuel/air ratio is increased, at a given rate, upon detection of the occurrence of misfiring. As another preferable embodiment of the above method, in step (a), the exhaust pressure is measured at a given crank angle of said internal combustion engine, and, in step (b), the occurrence of misfiring is determined by comparing the exhaust pressure with the average exhaust pressure up to the time when said exhaust pressure is measured.

Further, yet another important aspect of the present invention is an internal combustion engine comprising an apparatus for lean-burn control, said apparatus comprising: an exhaust pressure-sensing means for measuring the exhaust pressure at a detection point in an exhaust passage connected to an exhaust port of said internal combustion engine at least when said engine is subjected to lean combustion; a decision means for deciding whether misfiring occurs in said internal combustion engine, based on the measured exhaust pressure; and a control unit for controlling the fuel/air ratio of intake mixed gas introduced into said internal combustion engine, based on the occurrence of misfiring.

As was described above, this invention makes it possible to perform super-lean burning at the misfiring limits by detecting the exhaust pressure in the exhaust passage, and exercising lean-burn control with improved response rate by detecting misfiring, thereby effectively reducing $NO_x$ emissions. Further, the reliable detection of misfiring prevents unburned fuel from flowing out through the exhaust system, thereby improving fuel economy. Further, this combination with the catalyst not only enables the effective recovery of waste heat, but it effectively improves the cleansing of the exhaust gases and helps maintain stable catalytic function.

DETAILED DESCRIPTION OF THE PREFERRED EMBODIMENT

Referring now in detail to the drawings, an air-conditioning apparatus is shown.

The invention is shown in conjunction with an engine-driven air-conditioning apparatus for heating or cooling (including refrigeration), since the invention has particular utility in conjunction with an internal combustion engine in which lean-burn is advisable and which is equipped with a heat recovery system for recovering heat from the exhaust gas and an exhaust gas cleansing system. However, the invention can be embodied in conjunction with any internal combustion engine used in vehicles, such as two or four cycle mobile engines or outboard motor with plural cylinders. Those skilled in the art can readily understand how the invention can be utilized with any known type of internal combustion engine-associated systems.

Figure 1:
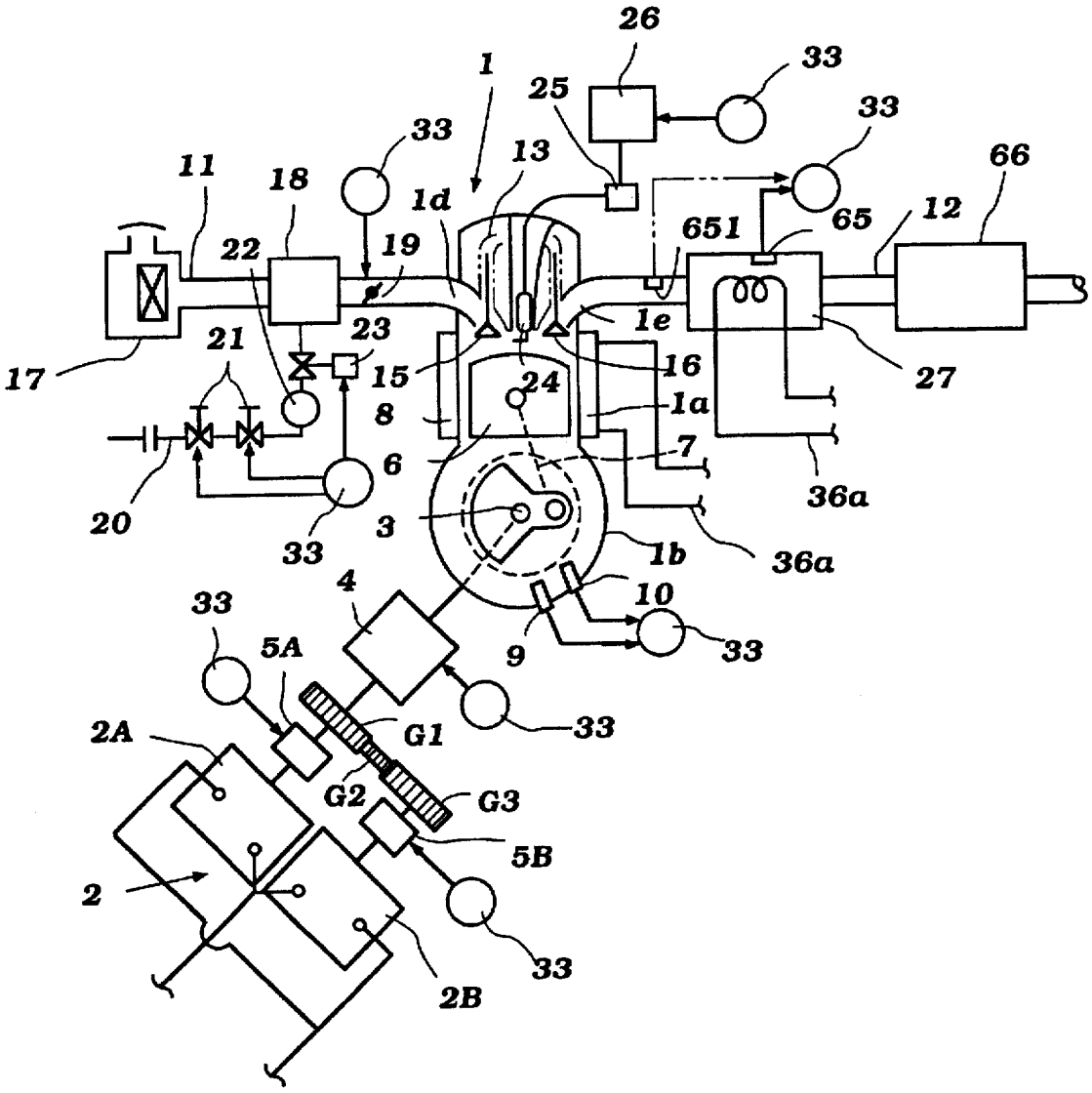
FIG. 1 is a structural diagram of an embodiment of the gas engine according to the present invention.

Basic Structures Associated With Gas Engine Used In Heat Pump Air-conditioning Apparatus FIG. 1 is a schematic illustration showing basic structures associated with a gas engine used in an air conditioning apparatus according to an embodiment of the present invention.

In a water-cooled gas engine 1 shown in FIG. 1, reference numeral 6 is a piston, reference numeral 7 is a connecting rod that joins the piston 6 with a crankshaft 3, reference numeral 8 is a cooling jacket formed around the cylinder 1*a*, reference numerals 9 and 10 are the respective engine RPM and crank angle sensors, which are cell motors attached to the end of the crankshaft and which are driven by the outside circumference of a ring gear attached to the bottom outside of a crankcase 1*b*.

An air intake pipe 11 and an exhaust pipe 12 are connected, respectively, to the air intake passage 1*d* and an exhaust passage 13 that are formed in a cylinder head 1*c* of the gas engine 1. The air intake passage 1*d* and the exhaust passage 1*e* are opened and closed in appropriate timing, by an air intake valve 15 and an exhaust valve 16 which are driven by rocker arms 13 and 14.

The air intake pipe 11 is also connected to an air cleaner 17 and a mixer 18 which mixes the air and the gas fuel, and a throttle valve 19 has been located inside the air intake pipe 11 downstream of the mixer 18. The mixer 18 is connected by a fuel supply line 20 with a gas supply from the fuel cylinder (not shown). Two opening/closing fuel valves 21, a zero governor 22 which regulates the gas pressure to a low level, and a fuel gas flow control valve 23 are located midway in said fuel supply line 20.

A spark plug 24 is also mounted in the cylinder head 1*c* of the gas engine 1, and said spark plug 24 is connected to an ignition coil 25 and to an ignition control circuit 26.

An exhaust gas heat-exchanger 27 is located in the exhaust pipe 12 and an exhaust pressure sensor 65 is located inside this exhaust gas heat exchanger. Reference numeral 2 (2A, 2B) represents two compressors that are driven by the gas engine 1 and the crankshaft 3 of the gas engine 1 is connected to a speed-increasing apparatus 4. The output shaft of the speed-increasing apparatus 4 is attached to one of the compressors (2A) via an electromagnetic clutch 5A. Further, a gear G1 attached to the output shaft of the speed increasing apparatus 4 engages, through a smaller diameter gear G2, a gear G3 which is of the same diameter as the gear G1. The gear G3 is linked to the other compressor 2B by an electromagnetic clutch 5B.

Figure 2:
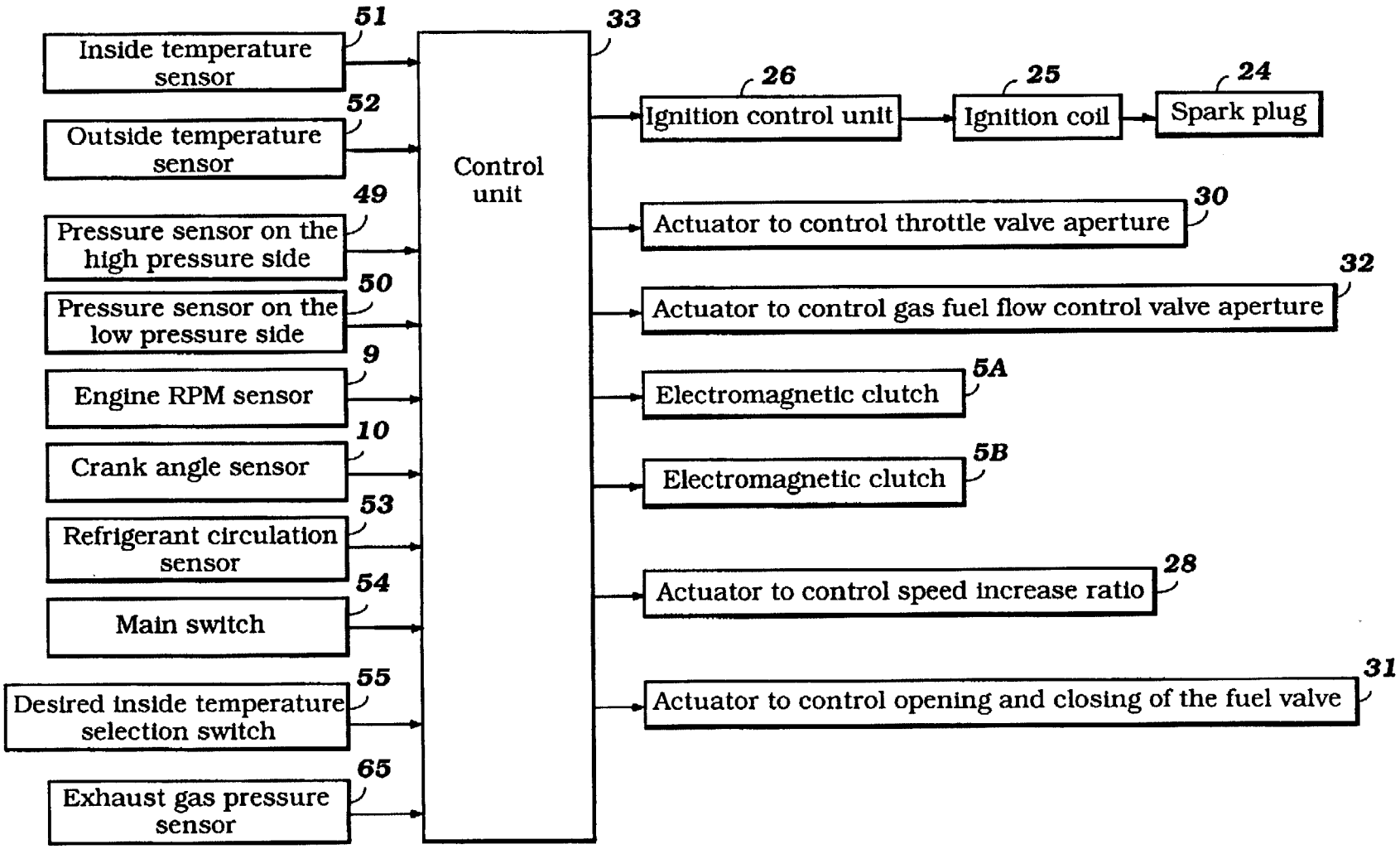
FIG. 2 is a block diagram of the drive control mechanism for the engine of FIG. 1.

As is shown in FIG. 2, the actuators 28, 30–32, the engine RPM sensor 9, the crank angle sensor 10, the electromagnetic clutches 5A and 5B, and the ignition control circuit 26 are connected to a control unit 33. The aperture of the throttle valve 19 is controlled by means of a throttle valve aperture control actuator 30 that operates based upon a control signal from the control unit 33. Similarly, opening and closing actuators 31 and 32 control the apertures of the opening and closing fuel valve 21 and of the fuel gas flow control valve 23.

Figure 3:
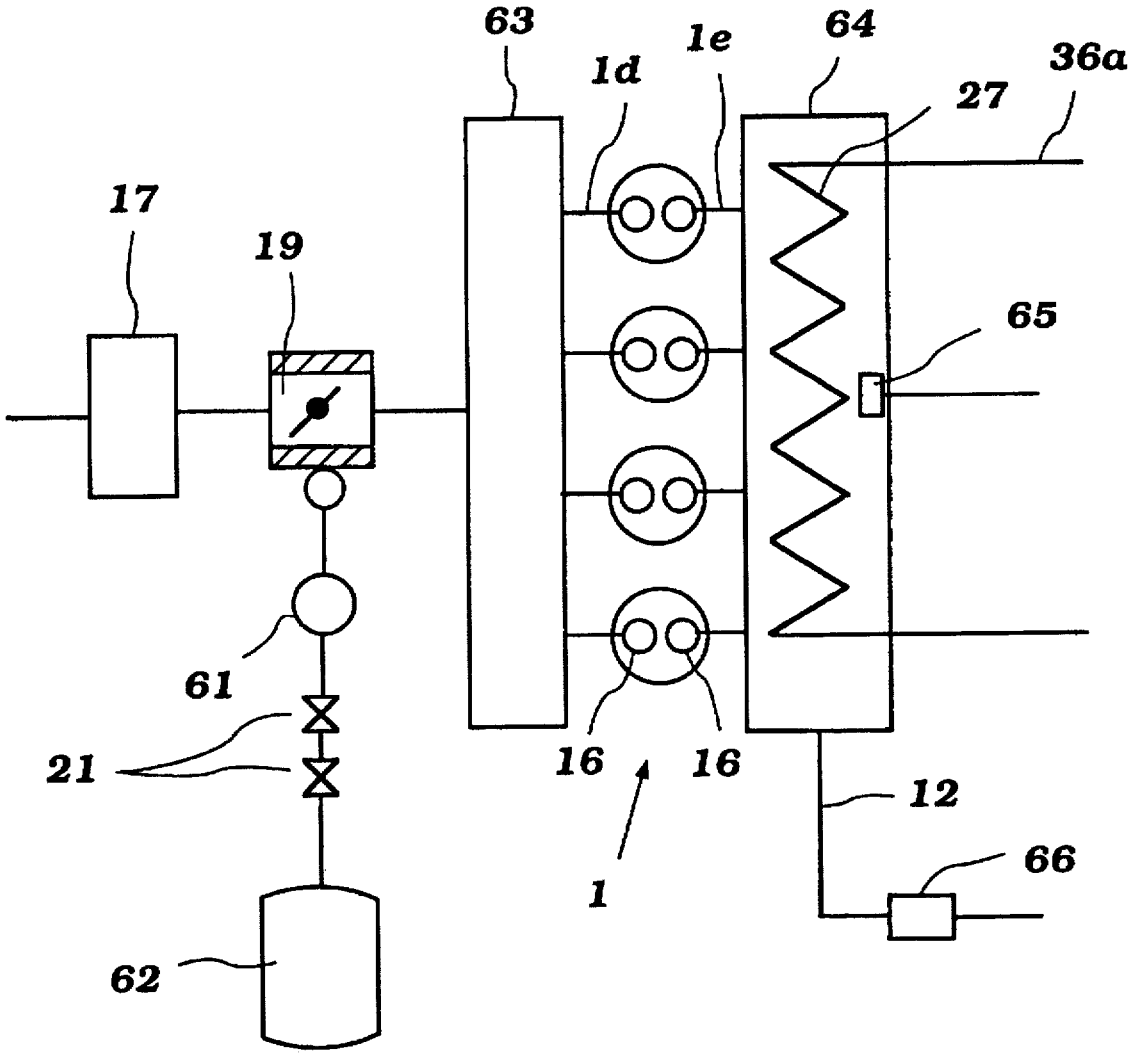
FIG. 3 is a structural diagram of the principal parts of an embodiment of the gas engine according to the present invention.

As is shown in FIG. 3, the engine of this invention is a four-cylinder engine and a fuel/air mixture is supplied to each cylinder from an air intake manifold 63 through the air intake passage 1*d*. Air is admitted into the intake manifold 63 through the air cleaner 17 and the throttle valve, and in the throttle valve area, gaseous fuel is supplied from the gas cylinder 62 through the control valve 21 and the pressure regulator 61. The exhaust passages 1*e* for each of the cylinders are connected to an exhaust manifold 64. The exhaust gas heat exchanger 27 is installed inside the exhaust manifold 64. It would also be possible to locate this exhaust gas heat exchanger 27 on the exhaust pipe on the downstream side of the exhaust manifold 64. An exhaust pressure sensor 65 is mounted inside the exhaust manifold 64. As is shown in FIG. 2, this exhaust pressure sensor 65 is connected to the control unit 33.

Basic Structures of Cleansing System

In FIG. 3, there is a catalytic converter 66 installed on the exhaust pipe 12 that connects to the exhaust manifold. Further, a heat exchanger 27 is mounted in the exhaust pipe 12, and a catalytic converter 66 may be located in the exhaust pipe 12 on the upstream side. This makes it possible to recover the heat of reaction from the catalyst for more efficient utilization of the waste heat.

Conversely, if the catalytic converter is located on the downstream side of the heat exchanger 27, it is possible to lower the exhaust gas temperatures and to prevent the catalyst from overheating, and thereby to maintain stable catalytic functioning. No matter which configuration is used, it will be necessary to consider the size of the air conditioning apparatus, the type of catalyst, and the conditions and space where it will be mounted.

Regardless of where the catalytic converter 66 is located, it is preferable that it be downstream of the pressure sensor 65. The reason is to avoid the effects on measurement of the pressure sensor 65 due to an change in gas volume passing through the pressure sensor 65, which change occurs in the exhaust gas whose volume is increased by chemical oxidation or reduction due to the action of the catalytic converter.

It is also possible to incorporate the catalytic converter 66 inside the heat exchanger 27. By so doing, it is possible to reduce the overall apparatus size and to conserve space, and additionally, to increase the design latitude in positioning the apparatus.

In this case, using an oxidizing catalyst, CO and HC could be cleansed from unburned gas when loss of ignition occurred, or by using a three-element catalyst, the reduction of CO and $NO_x$ would be even more effective.

Basic Structures of Heat Pump Apparatus

Figure 4:
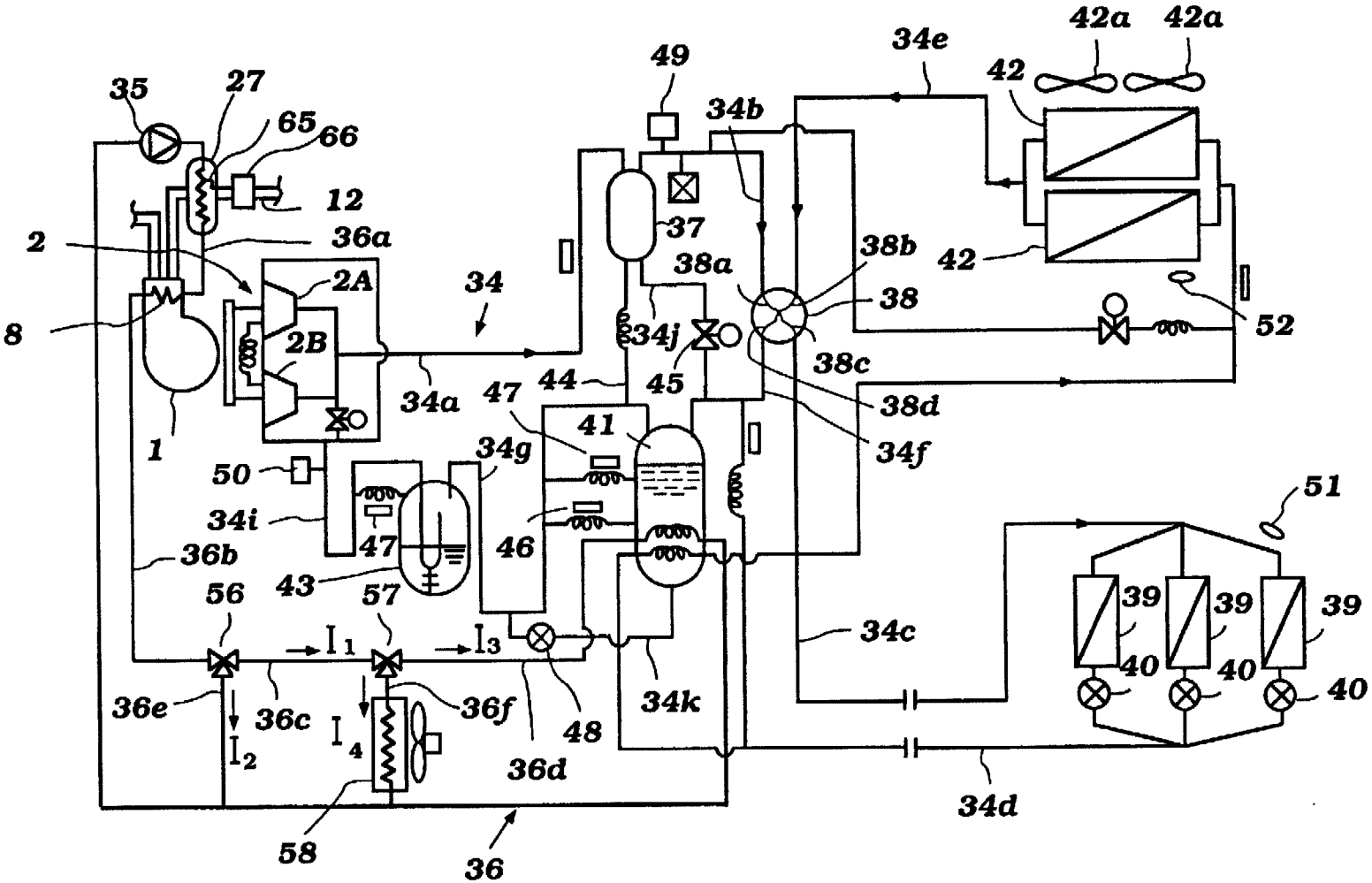
FIG. 4 is a structural diagram of the engine of FIG. 1 applied to a heat pump air-conditioning apparatus.

As is shown in FIG. 4, the heat pump includes a refrigerant circulation line 34 consisting of a closed loop containing the compressors 2 (2A, 2B), and a cooling water (coolant) circulation line 36, comprising a closed loop containing a water pump 35. The arrow in the figure in the refrigerant circulation line 34 shows the direction of refrigerant flow when a four-way valve 38 is in the heating mode wherein heating operations arc being performed.

The compressors 2 in the refrigerant circulation line 34 cause a refrigerant such as Freon to be circulated around the circulation line 34 that includes a refrigerant line 34*a* leading from the output of the compressors 2A and 2*b* to an oil separator 37; a refrigerant line 34*c* which runs from the four-way valve 38 to three inside heat exchangers 39; a refrigerant line 34*d* which runs from the inside heat exchangers 39 to two outside heat exchangers 34*e* via an expansion valve 40 and the inside of accumulator 41; a refrigerant line 34*f* which runs from the four-way valve 38 to the accumulator 41; a refrigerant line 34*g* which the from the accumulator 41 to a sub-accumulator 43, and a refrigerant line 34*i* which runs from the sub-accumulator 43 to the respective inlets of the compressors 2A and 2B.

An oil return line 44 and a bypass line 34*j* lead from the oil separator 37. The oil return line 44 connects to the refrigerant line 34*g*, and the bypass line 34*j* connects to the refrigerant line 34*f*. There is a bypass valve 45 located in this bypass line 34*j*. There are also liquid level sensors 46 and 47 located in the accumulator 41 and sub-accumulator 43 to detect the surface level of the liquid phase refrigerant therein, and a bypass line 34*k* primarily for oil return provided at the bottom of the accumulator 41 is connected to the refrigerant line 34*g*. A bypass valve 48 is provided in the bypass line 34*k*.

A high-pressure side pressure sensor 49 is provided in the refrigerant line 34*b*of the above-described refrigerant circulation line 34 in order to detect the pressure on the high-pressure side, and a low-pressure side pressure sensor 50 is provided in the refrigerant line 34*i*in order to detect the pressure on the low-pressure side. An inside temperature sensor 51 is mounted in the vicinity of the inside heat exchangers 39, and an outside temperature sensor 52 is located in the vicinity of the outside heat exchangers 42. As is shown in FIG. 2, the high-temperature side pressure sensor 49, the low-temperature side pressure sensor 50, the inside temperature sensor 51, and the outside temperature sensor 52 are connected to the control unit 33. Furthermore, as shown in FIG. 2, the refrigerant circulation sensor 53, the main switch, and the switch 55 to set the desired inside temperature are also connected to the control unit 33.

The cooling water circulation line 36 is the circulation line through which cooling water that cools the gas engine 1 is circulated by the water pump 35. It includes a cooling water line **36*a* which runs from the output side of the water pump 35 to the cooling water inlet of the gas engine 1 (which is the inlet to the water jacket 8 shown in FIG. 1) via the exhaust gas heat exchanger 27; a cooling water line 36*b* which runs from the cooling water outlet of the gas engine 1 (the outlet of the cooling water jacket 8) to the temperature-sensing switch valve 56; a cooling water line 36*c* which runs from the temperature-sensing switch valve 56 to the linear three-way valve 57; a cooling water line 36*d* which runs from the linear three-way valve 57 to the inlet side of the water pump 35 via the accumulator 41; and cooling water lines 36*e* and 36*f* which respectively run from the temperature-sensing switch valve 56 and the linear three-way valve 57 to the cooling water line 36*d*. A heat-exchanger 58 for radiating heat is provided on the cooling water line 36*f***.

When the gas engine 1 is operating, the rotation of its crankshaft is increased by means of the speed increasing apparatus 4, and in its ON condition, the electromagnetic clutch 5A transmits drive-force to the compressor 2A, while at the same time, gears G1, G2 and G3 in the ON condition transmit drive-force through the electromagnetic clutch 5B to the other compressor 2B to drive both compressors 2A and 2B simultaneously at the same RPM.

When the compressors 2A and 2B are being driven as described above, the situation is as shown in (1) in FIG. 5 (pressure P1, enthalpy i1) where the gas-phase refrigerant is drawn from the refrigerant line 34i iinto the compressors 2A and 2B and compressed, and becomes the high-temperature, high-pressure refrigerant in a state shown at (2) in FIG. 5 (pressure P2, enthalpy i2). At this time, the required drive for the compressors 2A and 2B (compression heat) AL is represented at (i2–i1). The pressure P1 of the gas-phase refrigerant drawn into the compressors 2A and 2B is detected by the low pressure side pressure sensor 50 and input into the control unit 33.

The high-temperature, high-pressure gas-phase refrigerant then passes through the refrigerant line **34*a* to the oil separator 37 where the oil is removed. After the oil has been separated from it, the gas-phase refrigerant passes through the refrigerant line 34*b* and reaches the four-way valve 38. The oil that is separated from the refrigerant in the oil separator 37 passes through the oil return line 44 into the refrigerant line 34*g*. The high-pressure side pressure sensor 49 detects the pressure P2 of the high temperature, high-pressure refrigerant flowing through refrigerant line 34*b*, and sends that information to the control unit 33**.

When heating operations are being performed, the ports **38*a* and 38*c*, and ports 38*b* and 38*d* of the four-way valve 38 are connected, respectively, then the high-temperature, high-pressure gas-phase refrigerant passes through the four-way valve 38 and flows to the refrigerant line 34*c* to the inside heat exchanger 39, which functions as a condenser. The high-temperature, high-pressure gas-phase refrigerant that has been conducted to the inside heat exchanger 39 then releases condensation heat Q2 into the inside air and liquefies. In the state shown by (3) in FIG. 5** (pressure P2, enthalpy i3) it becomes liquid refrigerant, and at this time, the heat released Q2 (=i2–i3) performs the heating of the air-conditioned room.

Figure 5:
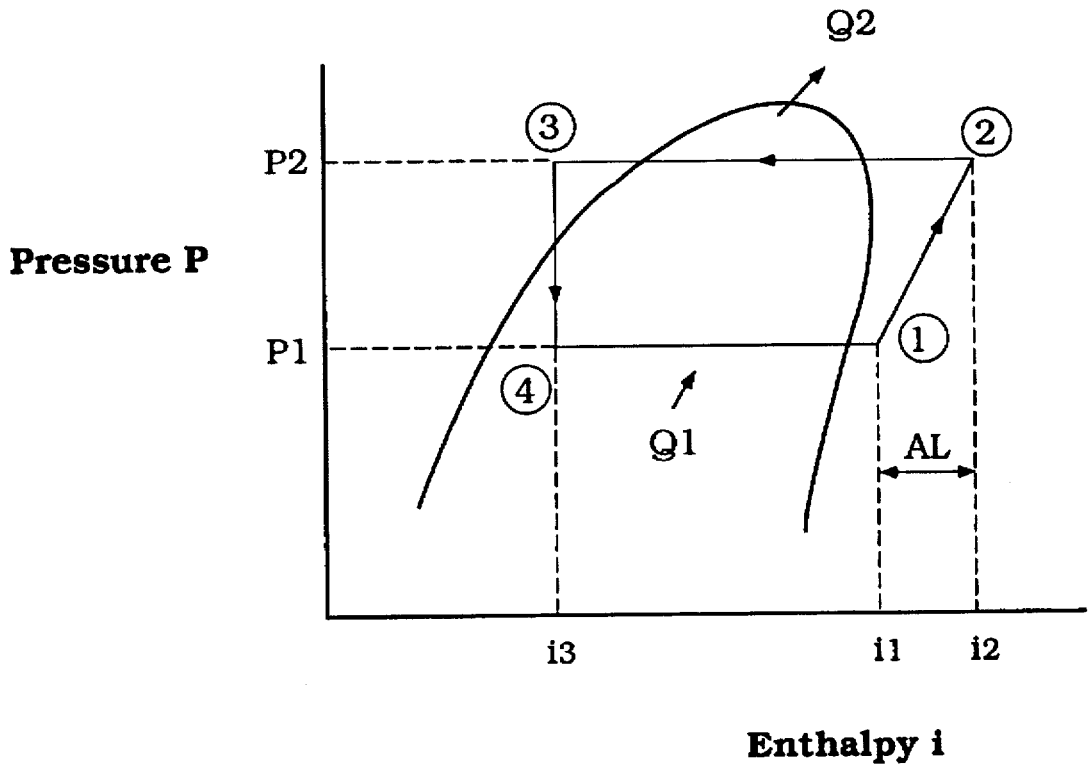
FIG. 5 is a p-i graph showing the relationship between refrigerant pressure and enthalpy of a heat pump air-conditioning apparatus according to the present invention.

Next, the high-pressure liquid phase refrigerant that was liquefied in the inside heat exchanger 39 has its pressure reduced by the expansion valve 40, whereupon it is in the state (4) shown in FIG. 5 (pressure P1, enthalpy i3) in which a portion of it has converted to a gas, and then it passes through refrigerant line **34*d* to the inside exchanger 42**.

Meanwhile, the drive of the water pump 35 causes the cooling water to circulate through the cooling water circulation line 36, and during that circulation, at the exhaust gas heat exchanger 27, the heat from the exhaust gas expelled from the gas engine 1 into the exhaust pipe 12 is recovered, and said gas engine 1 is then cooled by the circulation through the cooling water jacket of the gas engine 1. The cooling water that was heated by the exhaust gas heat exchanger 27 and the gas engine flows through the cooling water line **36*b* to the temperature-sensing switching valve 56**.

Just after the gas engine 1 is started, the cooling water temperature is still low so the temperature sensing switching valve 56 circulates the cooling water to cooling water line **36*e* and halts cooling water flow through cooling water line 36*c*. (I1=0) When the gas engine 1 reaches a normal operating state, the amount of heat exchanged at the exhaust gas exchanger and at the gas engine 1 increases, and as the temperature of the cooling water increases, the temperature sensing switch valve 56 causes the flow through cooling water line 36*e* to stop (I2=0), and permits cooling water to flow through line 36*c*. The three-way linear valve 57 distributes, according to the control unit 33, an amount of cooling water I1 as flow I2 into the cooling water line 36*d* and as-flow I4 into cooling water line 36*f***.

At the accumulator, the flow through cooling water line **36*d* heats up the liquid phase refrigerant stored in the accumulator 41 and that flowing through the refrigerant line 34*d*, thereby utilizing the waste heat from the gas engine 1 (the heat collected from the exhaust gas and from the cooling water). For example, the lower the outside temperature, the less the heat absorption from the outside heat exchanger 42**, so that, by increasing the flow I4 (and reducing the flow I3), the addition of waste heat to the refrigerant can be increased to secure the required amount of Q1.

As described above, after the refrigerant flowing through refrigerant line **34*d* is cooled as liquid-phase refrigerant in the accumulator 41, it reaches the outside heat exchanger 42, which functions as an evaporator; if the outside temperature is above a certain level, then the fan 43*a* on the outside heat exchanger is driven, and as described above, the refrigerant in the outside heat exchanger 42** collects heat from the outside air and evaporates.

Then, the refrigerant flows from the outside heat exchanger 42 through the refrigerant line **34*e* to the four-way valve 38, from where it passes to the refrigerant line 34*f* and into the accumulator 41**.

The liquid phase is separated from the refrigerant in the accumulator 41, and a part of the heat of the cooling water from the gas engine 1 that is flowing through the cooling water line **36*d*** is applied to the liquid-phase refrigerant, causing a part of the liquid-phase refrigerant to evaporate.

The gas-phase refrigerant in the accumulator 41 passes through the refrigerant line **34*g* into the sub-accumulator 43, from where it passes via another refrigerant line 34*i* into the compressors 2A, 2B. The gas-phase refrigerant that is drawn into the compressors 2A, 2B has returned to the condition (1) shown in FIG. 5 (pressure P1, enthalpy i1), so that this gas-phase refrigerant is repressurized by the compressors 2A, 2B** and subsequently the above action repeats.

Accordingly, from the time when the expansion valve 40 reduces the pressure of the refrigerant until the time it is drawn into the compressors 2A, 2B, heat from the gas engine 1 is applied to the refrigerant in the accumulator 41, and outside heat from the outside air is applied by the outside exchanger 42 and as a result, the heat value of the refrigerant Q1 (=il–i3) is removed and it evaporates, and is then further heated.

The above is one application example for this invention in a heat pump type of air conditioning device.

Lean-burn Operation Control

Figure 9:
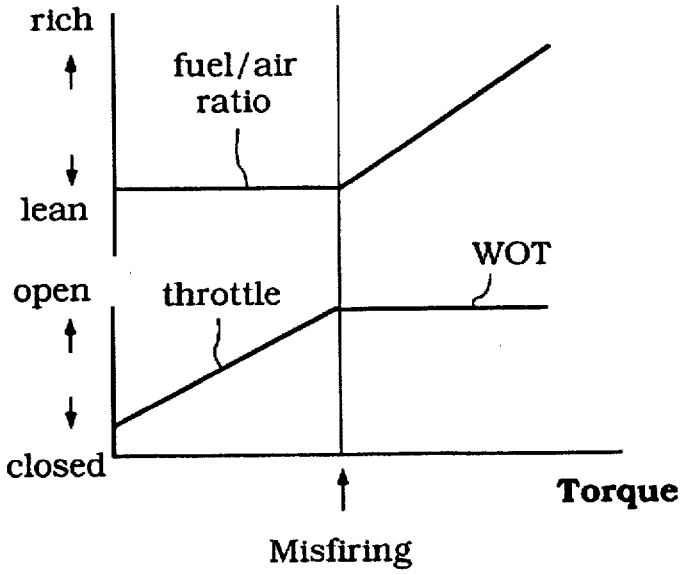
FIG. 9 shows the control concept of an engine according to the present invention.

Lean-burn control of the fuel/air ratio is performed at the limits of misfiring in the gas engine of this invention. In this case, the engine control, as shown in FIG. 9, is performed with a wholly opened throttle (WOT), and at torques higher than the torque (dotted line) where misfiring occurs, the required torque can be obtained using only fuel control; at torque levels below the dotted line where misfiring occurs, throttle aperture and the fuel control must be performed to obtain an fuel/air ratio at the limits of misfiring.

Figure 6:
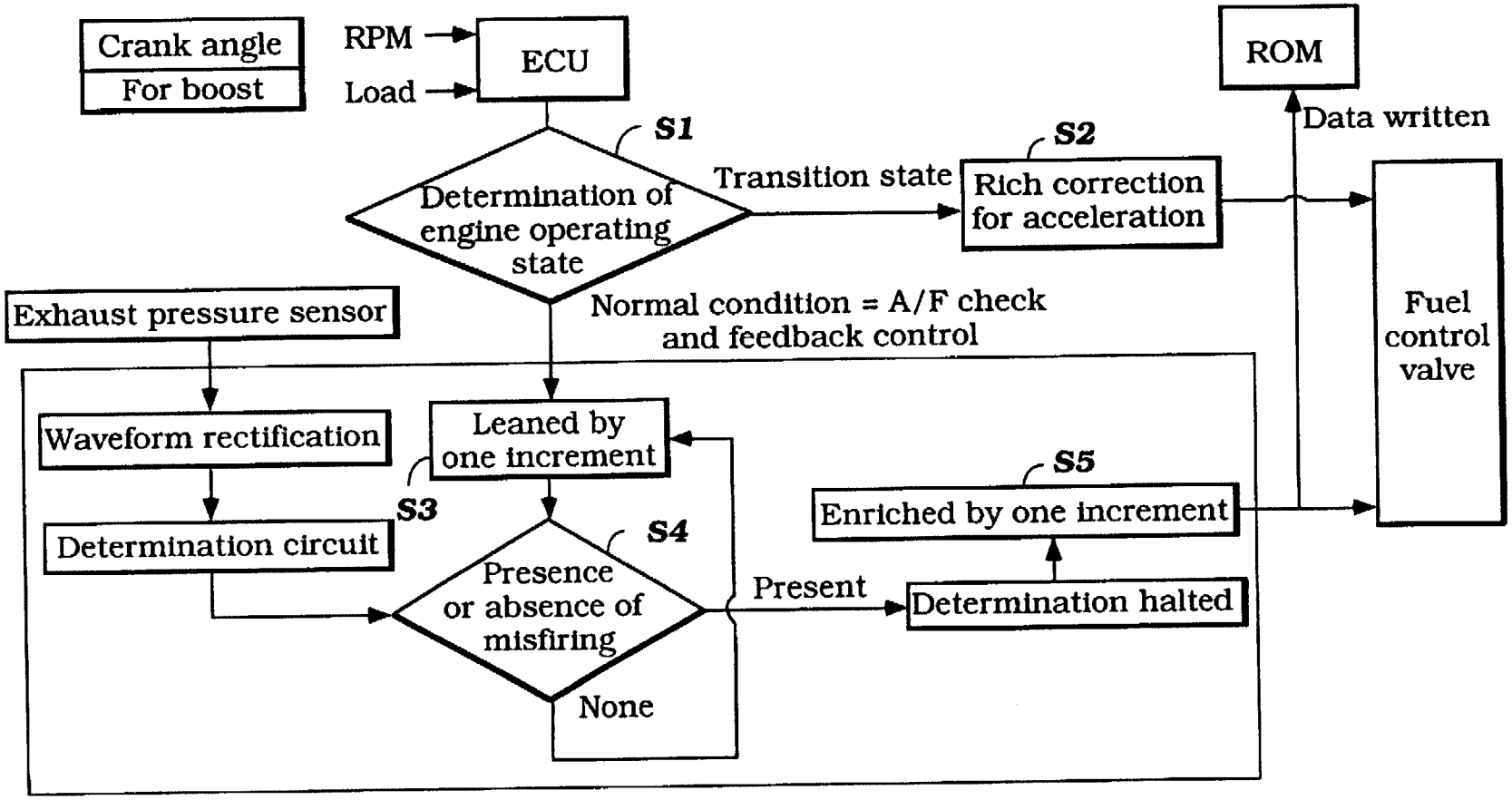
FIG. 6 is a block diagram showing lean-burn control in an embodiment according to the present invention.

FIG. 6 is a block diagram that shows the lean-burn control of a gas engine with the above described structure. The ECU (control unit) receives inputs of engine RPM and load information, and then, as shown in FIG. 2, it receives detection information from the various sensors. The control unit first determines the operating condition (step 1). Here a determination is made based upon the change in throttle valve aperture if it is in transition or in a static condition. If it is in transition, no lean-burn control is performed, the fuel control valve is driven (step S2) to supply a slightly rich mixture in a manner similar to an acceleration pump. When the engine load and engine RPM's reach a constant state, then the following lean-burn control measures are implemented to perform lean-burn control. First, the gas fuel supply is leaned by one step (step S3). At this point, a determination is made on whether or not misfiring has occurred (step S4). This determination is made in the manner described below by a determination circuit that rectifies the waveshape of the output signal from the exhaust pressure sensor 65. If misfiring has not occurred, the fuel is leaned another step and detection of misfiring is repeated. This leaning by one step is repeated so long as misfiring does not occur. When the limit for misfiring is detected, then the misfiring determination step is halted, and the fuel is enriched by one increment to recover from misfiring (step S5). This leaning or enrichment in single increments/steps is performed by pulse control of a step motor that drives the fuel supply valve. When misfiring does occur, in addition to enriching the fuel, a conversion is made into the target fuel/air mixture for lean-burn control based on map data stored in a ROM.

Figure 7:
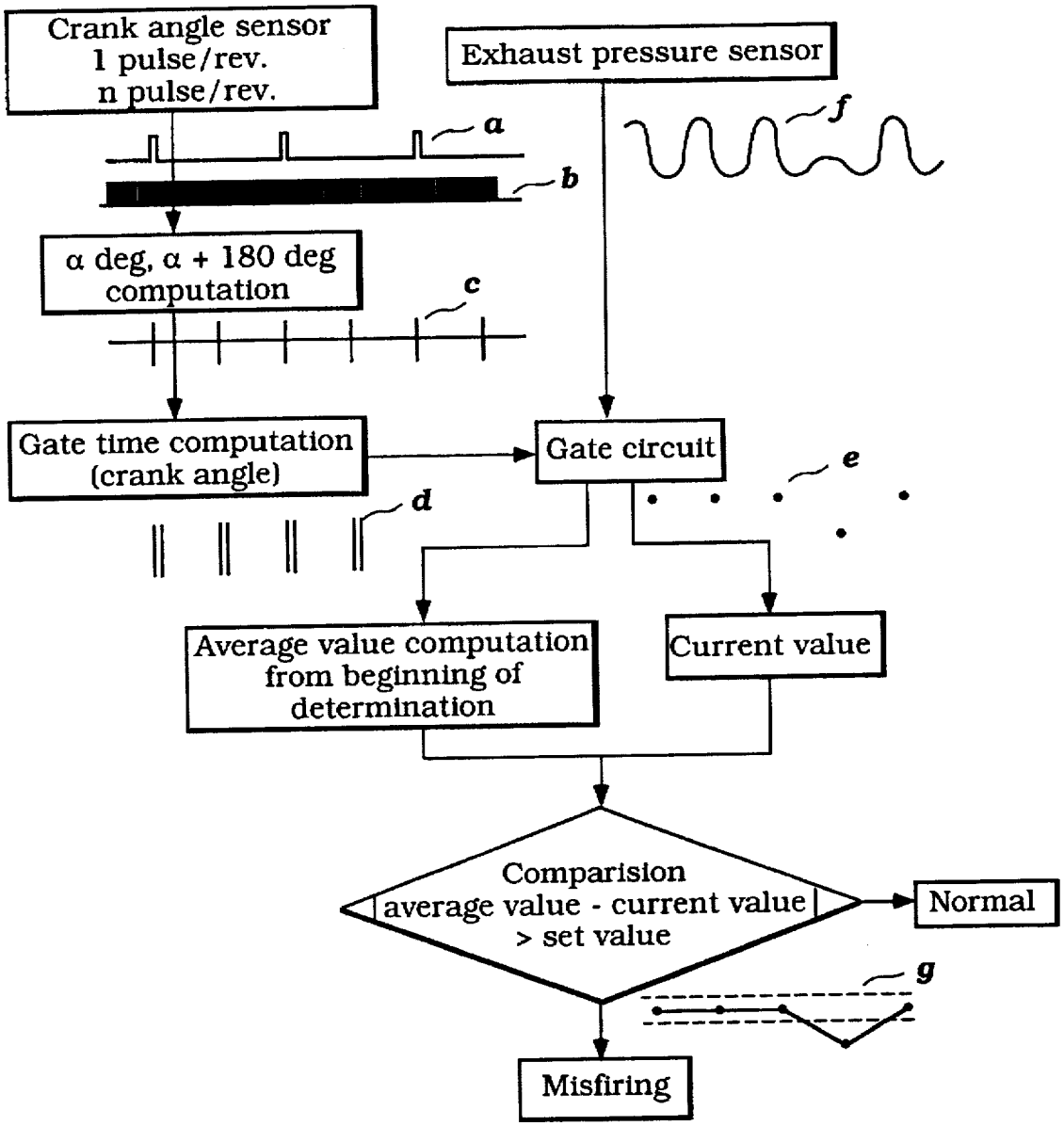
FIG. 7 is a flow chart to explain the detection of misfiring in the lean-burn control of FIG. 6.

FIG. 7 is a block diagram of the determination of misfiring. Pulse signal α and pulse signal b, from n pulses, are obtained from the crank angle sensor for each revolution. From this pulse information, the crank angle α where there would be a change in the exhaust pressure from misfiring is computed. Signal c is generated as a pulse at the α-position and at a position α+180° (at two positions per revolution). The gate time is computed for the detection of the exhaust pressure that corresponds to this α position, and signal d having prescribed intervals is formed. At this point, the detection signal f value from the exhaust pressure sensor is detected during this gate time for signal d, to obtain output data e. This pressure data is averaged over the interval since the pressure data control was initiated and used. The control device compares the averaged values with the exhaust pressure values taken at the α and the α+180° crank angles, and when the difference between them exceeds a certain value g, then misfiring is determined to have occurred.

Figure 8:
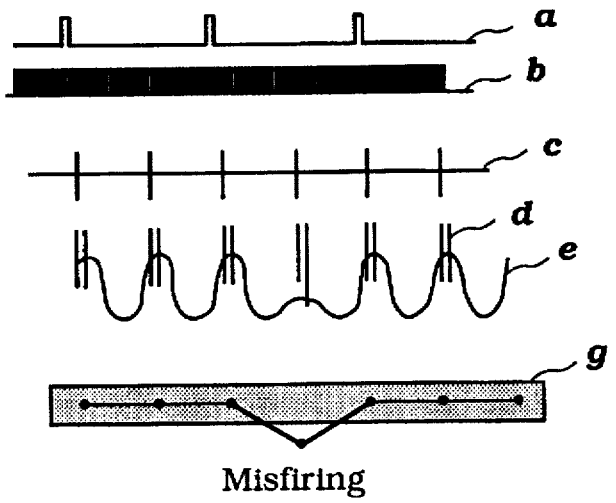
FIG. 8 explains the various signals appearing in the flow chart of FIG. 7.

FIG. 8 shows the signals with time. Signal α is, for example, the pulse signal at the upper dead point position; signal c shows the phase shift from the upper dead point pulse for the crank angle corresponding to α. The gate time signal d at this time is compared to the average value for the exhaust pressure e. When there is a big discrepancy between the current value and the average value, misfiring is determined to have occurred.

Characteristics of Lean-burn Control

As can be understood from the above explanation of the embodiment, lean-burn control of the present invention can be performed as follows:

Misfiring is determined based on an analysis of the detected exhaust pressure in the exhaust system (for example, inside the exhaust manifold). As one example of this analysis, a determination is made based on the pressure reading at a certain crank angle for a certain cylinder, and if this differs significantly when compared to the average exhaust pressure value, then misfiring is determined to have occurred.

Up until the point that misfiring is detected, the fuel/air mixture is leaned by specific steps, and then when misfiring is detected, the fuel/air ratio is increased, and by converting this feedback into target fuel/air data, it is possible to control the superlean burning operations to reduce $NO_x$ emissions and prevent unburned gas from entering the exhaust system.

It would also be possible to locate the exhaust pressure sensor 65 in an exhaust gas heat exchanger that doubles as a manifold where the exhaust passages 1*e* from each of the cylinders of a multi-cylinders engine merge. It would be possible to enrich the mixture immediately after misfiring has occurred in any cylinder. Also, the exhaust gases would expand in the exhaust gas heat exchanger 27, thereby reducing the heat load and pressure load on the exhaust pressure sensor 65, thereby enhancing its longevity.

It would also be possible to control the fuel/air mixture for each cylinder, for example by employing independent air intake passages 1*e*, throttle valves 1*d*, mixers 18, and gas fuel flow control valves 23 for each of the cylinders in a multi-cylinder engine. Exhaust pressure sensors 65' would then be installed in each of the exhaust passages 1*e*. The amount of gas fuel supplied and the throttle aperture for each of the cylinders would be based on the pressure in each of the exhaust passages 1*e* and be controlled by the above method to remain in the lean fuel/air mixture range. Compared to prior-art control of misfiring using vibrations, misfiring can be prevented much more reliably.

The determination of misfiring is made during normal operation when the aperture of the throttle valve is not changing, by comparing the exhaust pressure at a certain crank angle with the average exhaust pressure values. Accordingly, the high degree of precision that would be needed if absolute pressure values were used is not required, and pressure fluctuation can be reliably detected even if in the case of zero drift it would occur in the absolute value.

During normal operation, misfiring determination is conducted while turning the fuel valve one step at a time toward the lean side. At this time, the control program for the gas heat pump apparatus overall might compensate for the lowered torque from the leaning operation by gradually opening the throttle valve, but misfiring determination control would continue.

When the fuel/air ratio at misfiring limit is obtained from feedback, fuel valve data that is stored in the ROM can be converted into data that conforms to this fuel/air ratio. Thus, a continued feedback control process occurs during the feedback control.

Characteristics of Exhaust Pressure

The characteristics of the exhaust pressure detection in this invention are as follows:

1) The basic exhaust pressure waveshape during normal operation, for a four cylinder engine, has a peak (positive pressure wave) that appears after the opening of the exhaust valve following combustion, with a negative pressure wave following the peak, and the above pattern appears with every 180° rotation in the crank angle.
2) While there are cases where the wave pattern will be disturbed by interference waves caused by the effects on the exhaust pipe after the manifold of load and RPM, the deformation of the waveshape caused by misfiring is readily apparent when viewed on an oscilloscope.
3) The amplitude of the positive pressure wave varies proportionally with the throttle aperture and the RPM's.
4) When viewed on an oscilloscope screen, the differences between a normal combustion waveshape and the positive pressure wave and negative pressure waves when misfiring may be manifested as: a) the positive pressure wave that should appear at a certain crank angle drops off, b) the negative pressure wave that should appear at a certain crank angle drops off, c) the size of the positive pressure wave and/or negative pressure wave that should appear at certain crank angles is dramatically diminished, d) the size of the negative pressure wave that should appear at a certain crank angle position becomes very large, which also increases the amplitude of the next positive pressure wave.

In multiple cylinder gasoline engines, the pressure sensor can be mounted inside the exhaust manifold after the point where the manifolds from each cylinder merge, or inside an exhaust gas heat exchanger which also functions as a connector for exhaust manifolds. In this way, it is possible to detect misfiring in all of the cylinders simply by using one pressure sensor.

Characteristics of Cleansing System

It is possible to prevent any decline in the accuracy of ignition loss detection and to enhance the exhaust gas cleansing action by locating the catalytic converter on the downstream side of the exhaust pressure sensor in order to eliminate effects from pressure changes.

The heat of oxidation of the unburned gases can be recovered by locating the waste heat recovery heat exchanger downstream from the catalyst. On the other hand, the overheating of the catalyst can be prevented by locating the waste heat recovery heat exchanger upstream from the catalyst.

Further, the catalytic converter can be located internally in the heat exchanger to conserve space.

Lean-burn Control in Heat Pump Apparatus

For engine-driven heat pumps (air conditioners or freezers), when misfiring is detected from the exhaust pressure indicating too lean a mixture, misfiring is prevented by enriching the detected fuel/air mixture. Thus, when misfiring occurs, it is immediately prevented from recurring, and the exhaust gas temperature is kept high, which assures a heat supply available in the exhaust gas heat exchanger 27 for the cooling water. This arrangement improves the exhaust emissions from the engine driving the heat pump and improves fuel economy, while providing stable heating capacity, by making up for inadequate heat absorption (Q1) that occurs during heating when the outside temperatures are low, and by providing a stable source of heat from the cooling water to the refrigerant when energy input is required beyond that supplied by the compressors 2.

Further, when the four-way valve is switched over for cooling to connect ports 38*a* and 38*b* and ports 38*c* and 38*d* to make a refrigerator, there are cases where cooling or freezing is required even when the outside temperature is low. In this case, the heat emitted (Q2) from the outside heat exchanger 42 (which corresponds to the evaporator) is in surplus, so that the liquified refrigerant collects inside of the outside heat exchanger 42 and upstream of the expansion valve 40, and refrigerant circulation will stop. However, heat is supplied to the refrigerant inside the accumulator, and since the amount of heat absorbed (Q1) is considerable, the required refrigerant circulation is maintained. That is, even if misfiring is caused by leaning the mixture too much, the fuel/air ratio is immediately enriched to prevent it from recurring. Thus, with cooling devices or air-conditioning equipment driven by an engine, the exhaust emissions of the engine are improved along with its fuel economy even while maintaining stable cooling capability.

In the embodiment, the low-pressure circulation line employed a heat exchanger on the low-pressure side. However, similar effects to those obtained above could also be obtained by locating a receiver tank on the high-pressure side, and having the liquid refrigerant inside the receiver tank collect the engine waste heat that was in the circulating cooling water.

It would also be possible to control the linear three-way valve, during times when the mixture had been over-leaned and misfiring occurred, to increase the cooling water I3 for a certain period of time over the amount that had been circulated prior to misfiring. This could maintain the cooling or freezing capability, or the heating capability, until there was a recovery from misfiring.

It will be understood by those of skill in the art that numerous variations and modifications can be made without departing from the spirit of the present invention. Therefore, it should be clearly understood that the forms of the present invention are illustrative only and are not intended to limit the scope of the present invention.

What is claimed is:

1. An apparatus for lean-burn control of an internal combustion engine, comprising:

an exhaust pressure-sensing means for measuring the exhaust pressure at a detection point in an exhaust system of said internal combustion engine at least when said internal combustion engine is subjected to lean combustion;

a decision means for determining whether misfiring occurs in said internal combustion engine, based on the measured exhaust pressure; and a control unit for controlling the fuel/air ratio of intake mixed gas introduced into said internal combustion engine, based on the determination of the occurrence of misfiring.

2. An apparatus according to claim 1, wherein said exhaust pressure detection point is located in an exhaust passage connected to an exhaust port of said internal combustion engine.

3. An apparatus according to claim 1, further comprising a crank angle-sensing means for sensing the crank angle, wherein said exhaust pressure-sensing means is activated when said crank angle-sensing means senses a given crank angle, and wherein said decision means determines the occurrence of misfiring by comparing the sensed exhaust pressure with a given exhaust pressure at said given crank angle.

4. An apparatus according to claim 1, wherein said control unit controls a fuel control valve provided in said internal combustion engine, based on the determination of the occurrence of misfiring.

5. An apparatus according to claim 1, wherein said exhaust pressure-sensing means is disposed inside an exhaust manifold when furnished in said internal combustion engine.

6. An apparatus according to claim 1, wherein said exhaust pressure-sensing means is disposed in each exhaust passage when said internal combustion engine has multi cylinders.

7. An apparatus according to claim 1, further comprising a catalytic converter for cleansing exhaust gas downstream of said exhaust pressure detection point in an exhaust passage in said exhaust system.

8. An apparatus according to claim 7, further comprising a heat recovery means for recovering heat from the exhaust gas in said exhaust passage.

9. An apparatus according to claim 8, wherein said heat recovery means is disposed downstream of said catalytic converter.

10. An apparatus according to claim 8, wherein said heat recovery means is disposed upstream of said catalytic converter.

11. A method for lean-burn control of an internal combustion engine, comprising the steps of:

(a) measuring the exhaust pressure at a detection point in an exhaust system of said internal combustion engine at least when said internal combustion engine is subjected to lean combustion;

(b) determining the occurrence of misfiring in said internal combustion engine, based on the measured exhaust pressure; and (c) controlling the fuel/air ratio of intake mixed gas introduced into said internal combustion engine, based on the determination of the occurrence of misfiring.

12. A method according to claim 11, wherein, in step (a), said exhaust pressure detection point is located in an exhaust passage connected to an exhaust port of said internal combustion engine.

13. A method according to claim 11, wherein, in step (a), said internal combustion engine is subjected to lean combustion by decreasing, at a given rate, the fuel/air ratio of intake mixed gas introduced into said internal combustion engine in normal combustion, and wherein, in step (c), the fuel/air ratio is increased, at a given rate, upon detection of the occurrence of misfiring.

14. A method according to claim 11, wherein, in step (a), the exhaust pressure is measured at a given crank angle of said internal combustion engine, and wherein, in step (b), the occurrence of misfiring is determined by comparing the exhaust pressure with the average exhaust pressure up to the time when said exhaust pressure is measured.

15. A method according to claim 11, further comprising the step of catalytically cleansing exhaust gas downstream of said exhaust pressure detection point in said exhaust passage.

16. A method according to claim 15, further comprising the step of recovering heat from the exhaust gas prior to the cleansing step.

17. A method according to claim 15, wherein, in the cleansing step, the exhaust gas is cleansed downstream of said exhaust pressure detection point.

18. An internal combustion engine comprising an apparatus for lean-burn control, said apparatus comprising:

an exhaust pressure-sensing means for measuring the exhaust pressure at a detection point in an exhaust passage connected to an exhaust port of said internal combustion engine at least when said engine is subjected to lean combustion;

a decision means for determining whether misfiring occurs in said internal combustion engine, based on the measured exhaust pressure; and a control unit for controlling the fuel/air ratio of intake mixed gas introduced into said internal combustion engine, based on the determination of the occurrence of misfiring.

19. An internal combustion engine according to claim 18, further comprising a catalytic converter for cleansing exhaust gas downstream of said exhaust pressure detection point in said exhaust passage.

20. An internal combustion engine according to claim 18, wherein said internal combustion engine is an engine used in an engine-driven heat pump apparatus, said engine further comprising a heat-exchanger for exchanging heat between the exhaust gas and cooling water for cooling said engine, said heat-exchanger being disposed in an exhaust passage connected to an exhaust port of said engine.

21. An internal combustion engine according to claim 20, wherein said heat-exchanger is located downstream of the exhaust pressure detection point.

22. An internal combustion engine according to claim 20, wherein said exhaust pressure-sensing means is provided inside said heat-exchanger.

23. An internal combustion engine according to claim 19, further comprising a heat recovery means for recovering heat from the exhaust gas in said exhaust passage, wherein said heat recovery means is disposed downstream of said catalytic converter.

24. An internal combustion engine according to claim 19, further comprising a heat recovery means for recovering heat from the exhaust gas in said exhaust passage, said heat recovery means is disposed upstream of said catalytic converter.

* * * * *